US012653314B2

(12) United States Patent
Burger et al.

(10) Patent No.: US 12,653,314 B2
(45) Date of Patent: Jun. 16, 2026

(54) SEATING FURNITURE AND SEATING FURNITURE SYSTEM, AND METHOD FOR OPERATING A SEATING FURNITURE SYSTEM

(71) Applicant: MACK RIDES IP GMBH & CO. KG, Waldkirch (DE)

(72) Inventors: Günter Burger, Waldkirch (DE); Hubert Schill, Elzach (DE); Michael Moser, Elzach-Biederbach (DE); Christian Fahrlander, Waldkirch (DE); Baldeep Singh, Lahr (DE)

(73) Assignee: MACK RIDES IP GMBH & CO. KG, Waldkirch (DE)

( * ) Notice: Subject to any disclaimer, the term of this patent is extended or adjusted under 35 U.S.C. 154(b) by 339 days.

(21) Appl. No.: 18/281,522

(22) PCT Filed: Nov. 15, 2021

(86) PCT No.: PCT/EP2021/081661
§ 371 (c)(1),
(2) Date: Sep. 11, 2023

(87) PCT Pub. No.: WO2022/189013
PCT Pub. Date: Sep. 15, 2022

(65) Prior Publication Data

US 2024/0156267 A1 May 16, 2024

(30) Foreign Application Priority Data

Mar. 10, 2021 (DE) ..... 102021105860.0

(51) Int. Cl.
*A47C 7/72* (2006.01)
*A47B 83/02* (2006.01)
*A47C 9/02* (2006.01)

(52) U.S. Cl.
CPC ..... *A47C 7/72* (2013.01); *A47B 83/02* (2013.01); *A47C 9/022* (2013.01); *A47B 2200/0075* (2013.01)

(58) Field of Classification Search
CPC ..... A47C 7/72; A47C 9/022; A47B 83/02; A47B 2200/0075; A47B 2200/0072; A47B 2083/025
(Continued)

(56) References Cited

U.S. PATENT DOCUMENTS 5,299,810 A * 4/1994 Pierce ..... A63F 13/285 463/2
6,145,926 A * 11/2000 Lin ..... A47C 7/723 297/217.3
(Continued)

FOREIGN PATENT DOCUMENTS

DE 202018105028 U1 1/2020
DE 102018221465 A1 6/2020
(Continued)

OTHER PUBLICATIONS

Office Action in parallel pending Japanese patent application No. 2023-555281, issued by the Japanese Patent Office on Jun. 4, 2024.
(Continued)

*Primary Examiner* — Jose V Chen
(74) *Attorney, Agent, or Firm* — Nath, Goldberg & Meyer; Jerald L. Meyer; Morgan D. Rosenberg

(57) ABSTRACT

An item of seating furniture (2) includes a seating frame (11) with a running gear and with at least one seating assembly (12), along with a table assembly (14), a footrest (13), and a power storage system which supplies the seating furniture (2) with energy. The item of seating furniture (2) further includes a control unit and a comfort, work and/or entertainment device (15). The control unit controls the comfort,
(Continued)

work and/or entertainment device (15). In addition, a seating furniture system (1) having at least one item of seating furniture (2) is also provided.

15 Claims, 5 Drawing Sheets

(58) Field of Classification Search
USPC ..... 297/217.1, 217.5, 217.7
See application file for complete search history.

(56) References Cited

U.S. PATENT DOCUMENTS

| | | | | |
|---|---|---|---|---|
| 6,248,014 | B1 * | 6/2001 | Collier | A47C 7/72 454/231 |
| 6,296,408 | B1 * | 10/2001 | Larkin | A47C 7/72 400/681 |
| 6,530,842 | B1 * | 3/2003 | Wells | G07F 17/32 463/16 |
| 6,733,293 | B2 * | 5/2004 | Baker | G09B 19/16 472/60 |
| 7,598,881 | B2 * | 10/2009 | Morgan | B60R 21/01534 340/552 |
| 9,142,083 | B2 * | 9/2015 | Granger | G07F 17/3216 |
| 9,167,894 | B2 * | 10/2015 | DesRoches | A47B 21/00 |
| 9,554,966 | B2 * | 1/2017 | Kuro | A63B 21/4047 |
| 10,174,515 | B1 * | 1/2019 | Krivens | A47B 83/02 |
| 10,269,207 | B2 * | 4/2019 | Gronkowski | G07F 9/023 |
| 10,655,349 | B1 | 5/2020 | Krivens | |
| 10,779,647 | B2 * | 9/2020 | Amit | H05B 45/20 |
| 10,827,829 | B1 * | 11/2020 | Labrosse | G05B 15/02 |
| 11,058,216 | B2 * | 7/2021 | Hansen | A47B 9/00 |
| 11,116,315 | B2 * | 9/2021 | Hoffman | A47B 83/001 |
| 12,376,677 | B1 * | 8/2025 | Labrosse | A47C 7/748 |
| 2004/0254020 | A1 * | 12/2004 | Dragusin | A47C 15/004 463/46 |
| 2006/0012118 | A1 * | 1/2006 | Mamitsu | A63F 13/818 463/6 |
| 2006/0119233 | A1 * | 6/2006 | Thomas | A47B 21/00 312/235.9 |
| 2009/0236883 | A1 * | 9/2009 | Sugiyama | B60N 2/976 297/217.1 |
| 2010/0301640 | A1 | 12/2010 | Heiser | |
| 2011/0285186 | A1 * | 11/2011 | Demmelmeier | B60N 2/0277 701/49 |
| 2016/0095442 | A1 | 4/2016 | Gehner | |
| 2018/0104578 | A1 * | 4/2018 | Travis | G06F 3/016 |
| 2018/0199716 | A1 * | 7/2018 | Bertinato | A47C 7/72 |
| 2019/0111337 | A1 * | 4/2019 | Ergen | A63F 13/235 |
| 2022/0257033 | A1 * | 8/2022 | Burger | A47C 1/12 |
| 2024/0262340 | A1 * | 8/2024 | Numajiri | A47C 7/72 |

FOREIGN PATENT DOCUMENTS

| | | | | |
|---|---|---|---|---|
| DE | 102019113011 | A1 * | 11/2020 | A47F 10/06 |
| DE | 102019113013 | A1 | 11/2020 | |
| JP | 2001279938 | A | 10/2001 | |
| JP | 2003310761 | A | 11/2003 | |
| WO | 2010/040749 | A1 | 4/2010 | |
| WO | 2020/229637 | A1 | 5/2020 | |

OTHER PUBLICATIONS

Office action issued Mar. 10, 2021, in corresponding DE application No. 102021105860.1.

Tesla Model Y owners manual published Oct. 29, 2020.

Office Action dated Oct. 31, 2025 corresponding to Chinese patent application No. 202180095401.8.

* cited by examiner

SEATING FURNITURE AND SEATING FURNITURE SYSTEM, AND METHOD FOR OPERATING A SEATING FURNITURE SYSTEM

This is a National Phase Application filed under 35 U.S.C. 371 as a national stage of PCT/EP2021/081661, filed Nov. 15, 2021, an application claiming the benefit of German Application No. 10 2021 105 860.0 filed Mar. 10, 2021, the content of each of which is hereby incorporated by reference in its entirety.

BACKGROUND

Field of the Invention

The present invention relates to an item of seating furniture, a seating furniture system and to a method for operating a seating furniture system.

Description of Related Art

Seating furniture is already known from the prior art in different designs. Seating furniture with a seating assembly and seating furniture with a seating assembly and a table assembly, where the seating assembly and the table assembly are permanently interconnected, are known. Items of seating furniture of this kind are also called chair-tables.

A disadvantage of this known seating furniture is a low level of flexibility and intensive use of the office and circulation areas. The cleaning is also very complex and costly in terms of thoroughness, personnel requirements, and cleaning times. In addition, it has been shown that the comfort of such known seating furniture items is low and they cannot be used in a variety of ways.

Proceeding from this prior art, it is the object of the present invention to propose an improved item of seating furniture and an improved seating system that meets the actual needs of tomorrow and the day after tomorrow and can be used in a variety of ways in the world of work, as well as in the field of education and entertainment. These objects are achieved by an item of seating furniture having the features of claim 1, by a seating furniture system having the features of claim 11 and by a method for operating a seating furniture system according to claim 13.

Further advantageous embodiments are specified in the dependent claims.

SUMMARY

The item of seating furniture according to the invention has a seating frame with a running gear, at least one seating assembly, and a footrest. Furthermore, the item of seating furniture has a power storage system which supplies the seating furniture with energy, and a control unit, it being possible for the control unit to control a comfort, work, and/or entertainment device.

The item of seating furniture according to the invention enables a quick arrangement or rearrangement of different seating furniture assemblies, e.g., of work groups, according to the information, entertainment, educational format or work environment to be conveyed. The running gear creates flexibility when switching rooms. Optionally, the surroundings can be switched or visual axes can be changed by moving the seating furniture by hand or by motor in order to increase the user's attention. The running gear enables smooth-running and energy-saving arrangement or rearrangement.

The controller unites all intelligence, which means that the seating furniture can adapt to a constantly changing everyday life. Seating furniture of this kind can be used in the office, education, and leisure sectors, with the smart controller of the control unit enabling these uses to be adapted to the individualized formats by appropriately controlling the comfort, work, and/or entertainment device.

The proposed item of seating furniture can be used for new and mobile office solutions, for example, since the seating furniture can be configured in almost any way in terms of size and equipment. In times when it is to be expected that office space will only be used partially and no longer continuously and permanently due to increased mobile work, it could happen that relatively large offices have to be kept available and hardly anyone is there. There are also meeting and conference rooms. With the seating furniture and the seating furniture system, which will be described in detail below, everything can become one, making it possible to create a much more flexible and attractive office world and leisure world with smaller spatial and niche concepts, which can be reformatted very quickly from classic office and leisure designs with a single item of seating furniture or a few individual items of seating furniture in order to meet the requirements of different formats. In some cases, for example, work groups can be formed very quickly, with the seating furniture being able to be arranged manually or, as will be described in detail below, via the controller and/or the driven running gear. Optionally, the running gear can be adapted relatively easily to different surfaces and thresholds, which can be particularly advantageous for existing buildings.

The proposed item of seating furniture has a power storage system, which can preferably be charged via off-peak electricity and can easily supply the seating furniture with electricity for a whole day. Energy can be stored via the proposed seating furniture if the procurement of energy is most favorable in terms of network utilization. The power storage system can either be charged at a charging station of a seating furniture system or, for example, in inductive areas of the seating furniture system. In addition to the power storage system, a permanent power supply can also be provided via contacts, cables, or inductively.

According to a development of the seating furniture, the running gear is driven by a drive. The controller can control the drive in such a way that the vehicle can be moved autonomously or controlled by inputs. Steering movements can be accomplished either by the running gear and/or by the drive. As a result, the item of seating furniture can be individually moved electrically by the user to a desired position, for example. A combination of individually automated deformability is also possible. For example, the item of seating furniture can be moved to target coordinates automatically, electrically, or autonomously, and can be moved individually by the user to the target coordinates in order to adapt to the user's habits, preferences, or the like. Due to the basic principle, such an item of seating furniture is primarily an excellent way to allow people with disabilities to participate. With appropriate individualized additions or adjustments, it is possible to cater even further to integration for a worthy cause.

According to a development of the item of seating furniture, the comfort, work, and/or entertainment device can adjust a seat position of the seating assembly between at least two seat positions, one of the at least two seat positions comprising a lounge seat position, a working chair position, a standing stool position, or a leaning position. The item of seating furniture enables sitting positions from a cozy lounge character to typical office ergonomics to standing or leaning furniture, which means that the seating furniture can be individualized. The sitting position is preferably adjusted either manually or by means of appropriate actuators in the seating assembly.

Furthermore, the item of seating furniture can have a table assembly. The table assembly can have a work surface, it being preferably possible to make adjustments in height, depth, inclination, and rotation and/or further settings. The adjustment can be done manually or automatically.

According to a development, the comfort, work, and/or entertainment device comprises a stimulation or massage device of the seating assembly, an air conditioning system or ventilation system, an air conditioning system or ventilation system of the seating assembly, and/or an air conditioning system of a foot space on the footrest. It is possible to create an atmosphere around the seating furniture that provides the highest level of comfort, to create a creative and focused working atmosphere, or even a cozy atmosphere to relax in. The comfort, work, and/or entertainment device can also include an IR, UVA, and UVB light source, by means of which the user can be irradiated. The comfort, work, and/or entertainment device can also comprise one or more audio and/or video output devices.

In one development, the comfort, work, and/or entertainment device can add additives to the air for air conditioning or ventilation; these additives are gently emitted to a health-promoting extent, for example to improve concentration and/or wellbeing. For example, oxygen from an oxygen cartridge of the seating furniture can be added to the air. Fragrances can also be added to the air.

Furthermore, user identification means can be provided. For example, a user can log on to the item of seating furniture via an app and/or register on the item of seating furniture by scanning a code, for example a QR code. The user identification means can, for example, cause configurations of the seating furniture to be loaded and the controller then makes appropriate adjustments to the seating furniture, such as adjustments to the seating assembly and/or the table assembly. The item of seating furniture can also be addressed remotely and, for example, after being called up by an app, can be driven autonomously to a deployment location for the user.

At this point it should be noted that the item of seating furniture can have appropriate sensors that enable autonomous driving of the seating furniture. At the same time, these sensors can be used to maintain distances from other objects, for example, or to maintain distances between two items of seating furniture, which enables simple implementation of a hygiene concept.

In addition, a sensor system can also be provided which, for example, records the air quality (cleanliness, temperature, flow, etc.) and can be used, for example, in conjunction with communication options for controlling a home automation system. The sensor system can also be provided with bidirectional functions or information.

Alternatively or additionally, the sensor system can record voice commands and/or gestures by the user. The control unit triggers at least one control command in response to voice commands and/or gestures by the user and controls the drive and/or the comfort, work, and/or entertainment device accordingly.

The item of seating furniture can also have one or more storage options. Such a storage option can be, for example, a small safe or cupboard that can be used to store personal items. In a preferred embodiment, the storage option also has locking means which can preferably be opened and closed by the user identification means. The storage option can also be air-conditioned and store, for example, snacks or soft drinks which can be made available to the user, for example at a conference, a meeting, a training course, or the like. The at least one storage option also allows other objects to be integrated, such as filing cabinets, in other niche solutions.

For example, the storage option can hold training items. Such a training item can be a robot training item, for example, with each item of furniture carrying a collaborative robot with and on which training can take place. For example, the item of seating furniture can travel a course by means of the running gear, with training tasks such as programming and/or practical tasks having to be mastered. For example, a part can be picked up at one position by a gripper and set down again at the next stop where a new part can be picked up. Success and failure are automatically logged via corresponding on-board sensors or an off-board unit of the seating furniture system described below and are automatically entered in an automated evaluation system.

The comfort, work, and/or entertainment device can also comprise a multimedia conference device and/or a computer workstation, as a result of which all important and up-to-date office or IT functions can be made available to the user. The comfort, work and/or entertainment device can enable networked work and can be connected, for example, to other functions of the seating furniture system, such as a data server, a printer, or the like. The item of seating furniture thus represents a sophisticated media unit that can be equipped with extensive software and service packages and adapted to business and/or training purposes. For example, the seating assembly can include a timer with a countdown, which can be used for brainstorming, for example. Tasks, work results, and/or work statuses can be transmitted automatically, for example. Presentations can be shared, for example with optimized ergonomics and presentation settings as well as individualized marker functions. System-integrated and/or individualized information on general topics such as breaks, fitness, etc. can also be output, for example also via the comfort, work, and/or entertainment device in the form of vibrations or acoustic information.

Each item of seating furniture can have a request button for help and services by a real person and/or on a virtual basis. Display means can also be provided in the manner of a signaling column, which can display a status such as “do not disturb” or “help needed”.

In terms of media, each item of seating furniture can be extensively adapted for the different formats in connection with the software, for example the passing on the role of speaker. For this purpose, a microphone can be activated or deactivated, as well as an output unit for playing back media content. This can also be done in conjunction with a presentation of a particular image or video clip with participants on site and, if necessary, via a video call. Further adjustments of the comfort, work, and/or entertainment device can be made, such as positioning the item of seating furniture in an exposed position and/or partially automated raising of the seating assembly and/or the table assembly, for example to a standing desk or the like.

The output unit can comprise one or more screens, which can be arranged on the table assembly, for example. The output unit can comprise a touch monitor, for example, in order to enable interactivity during presentations or group work.

According to a preferred development of the present invention, a shielding device is provided. The shielding device can, for example, implement a soundproofing concept or a privacy concept, as a result of which an improved atmosphere can be created. The shielding device can, for example, have a convertible top that can be folded up and/or be designed in the manner of a hard top, which can be activated manually or automatically or put on separately. The shielding device can protect against prying eyes and/or serve to isolate the individual from noise that affects oneself and/or others.

Furthermore, according to a development of the present invention, coupling means are provided, by means of which additional objects can be coupled to the item of seating furniture. The coupling means can be used to couple mechanically or programmably or using automation, to couple mobile additional objects without their own drive, such as plants, a filing cabinet, an additional shelf, a table assembly, or the like with the seating furniture. The additional object can also have the drive by which the item of seating furniture can be moved in a driven manner. The additional objects can be retrieved from a storage facility as required and coupled to the item of seating furniture either manually or by means of a program. After use or when not in use, the additional objects can be stored again in the storage facility. The technology in each item of seating furniture can be reduced to the bare minimum by means of the coupling means, and each item of seating furniture can be adapted to the respective formats.

The item of seating furniture can be partially foldable and/or stackable.

In this function, the item of seating furniture can also be used as a means of transport, preferably adopting the automated driving characteristic of the seating furniture.

The item of seating furniture can comprise interfaces and/or a power supply, via which the user's individual hardware can be connected to the seating furniture. The power supply can comprise a socket and/or a USB plug, for example. The interfaces can be wired or wireless. The user's individual hardware (such as a smartphone, tablet, laptop, or similar) can be coupled to the comfort, work, and/or entertainment device and thus to the output and input devices in order to make personal settings more convenient to use.

The item of seating furniture can also receive user profiles or user configurations from other IT workstations via the interface. In particular, this can be done in connection with the user identification means.

A further aspect of the present invention relates to a seating furniture system having at least one item of seating furniture as described above and a higher-level controller, the higher-level controller being connected to the controller of the at least one item of seating furniture. The communication between the higher-level controller and the controller of the at least one item of seating furniture can be unidirectional or bidirectional. For example, the higher-level controller can comprise a booking system, whereby the at least one item of seating furniture can be booked in a similar way to seats in an airplane. In conjunction with a card, the at least one item of seating furniture can be assigned to a user. An organizationally and strategically planned competence configuration can also be implemented by a decision-maker, for example. A configuration program can be provided, for example, which generates an arrangement of the at least one seating assembly within an available area, preferably visually using drag & drop. The configuration program can generate such an arrangement semi- or fully automatically. For example, the arrangement can be generated in connection with a team organization, with the team organization assigning functions and/or additional objects to the relevant user, for example, depending on their tasks and the assigned role. The arrangements and configurations can be adjusted, preferably fully automatically, which means that a corresponding room with all functions can be created automatically for each format.

The networking between the higher-level controller and the controller of the at least one item of seating furniture provides the opportunity for preventive maintenance, for example via an integrative software module that detects any impending problems via motor data or a sensor system. The software can be optimized to such an extent that the use and maintenance intervals are optimally coordinated and a high level of availability of the at least one item of seating furniture is ensured. The system can thus register itself for maintenance, updates, cleaning, etc. according to defined criteria and taking into account, for example, bookings, and in addition, in a preferred development, also visit an appropriate room itself.

According to a development of the present invention, at least one charging station is provided, by means of which the power storage system of the item of seating furniture can be charged. The at least one charging station can be designed as a docking station, for example, and/or have at least one inductive area.

Furthermore, it can be advantageous if the seating furniture system has a cleaning station. Each item of seating furniture can, for example, be driven autonomously to the cleaning station, for example a disinfection point. The furniture system can automatically acknowledge the cleaning, as a result of which improved hygiene concepts can be implemented.

A third aspect of the present invention relates to a method for operating a seating furniture system having at least one item of seating furniture, the controller of the item of seating furniture being addressed in order to move the item of seating furniture by means of the drive. As a result, an arrangement or rearrangement of the at least one item of seating furniture can take place automatically in order to form seating furniture assemblies corresponding to the information, leisure, or educational format to be conveyed. The autonomous movement of the at least one item of seating furniture can also optimize the cleaning and care of rooms, for example by moving the seating furniture accordingly for cleaning and returning to a corresponding seating assembly after cleaning, in particular after cleaning by a robot.

In particular, it is advantageous if the seating furniture assembly is arranged on the basis of an initial questionnaire and corresponding AI-optimized groupings of users, as a result of which improved and goal-oriented working atmospheres can be created.

Furthermore, it has proven to be advantageous when carrying out the method according to the invention if the controller controls the comfort, work, and/or entertainment device of the at least one item of seating furniture and preferably makes adjustments to the comfort, work, and/or entertainment device that are saved in the user profile or a global application profile. The user profile can be called up, for example, by means of user identification.

According to a development of the present method, the at least one item of seating furniture can travel autonomously to a deployment location, a charging station, and/or a cleaning station.

The seating furniture system can also be used in the service sector. For example, the seating furniture system can be used by service providers such as hairdressers, doctors, etc., so that the ergonomics, hygiene, and/or luxury aspects can be optimized for the customer. For example, the comfort, work, and/or entertainment device can enable internet access, a massage function, special seating comfort, or play films or music in order to occupy time during the stay or the waiting time. Especially in terms of ergonomics, the seating furniture can be adapted to the particular needs of the service provider's customer. The preferential conditions of the customer can be stored—subject to consent. Waiting times can also offer added value for the customer, since other services such as massage, infrared, solarium, or the like can be offered. In particular, the seating furniture can be used in the registration area and waiting area of medical practices and in outpatient areas of hospitals. This enables, for example, a digitized registration process and optimization thereof. The waiting time can also be designed to be more service-friendly or using multimedia, and the furniture system can reduce personnel costs and make processes more economical. In particular, this can also be done in conjunction with an optimized hygiene concept, in terms of minimum distances and process reliability when disinfecting the at least one item of seating furniture. For example, an automated vaccination course or treatment course could be implemented with all administrative, treatment-specific, social, and hygiene-specific requirements within an improved process reliability framework.

BRIEF DESCRIPTION OF THE DRAWINGS

An exemplary embodiment of an item of seating furniture is described in detail below with reference to the accompanying drawings, in which:

FIG. 6 is a block diagram illustrating system components of the item of seating furniture.

Identical or functionally identical components are identified below with the same reference symbols. For the sake of clarity, not all parts that are the same or functionally the same are provided with a reference number in the individual figures.

DETAILED DESCRIPTION

Figure 1:
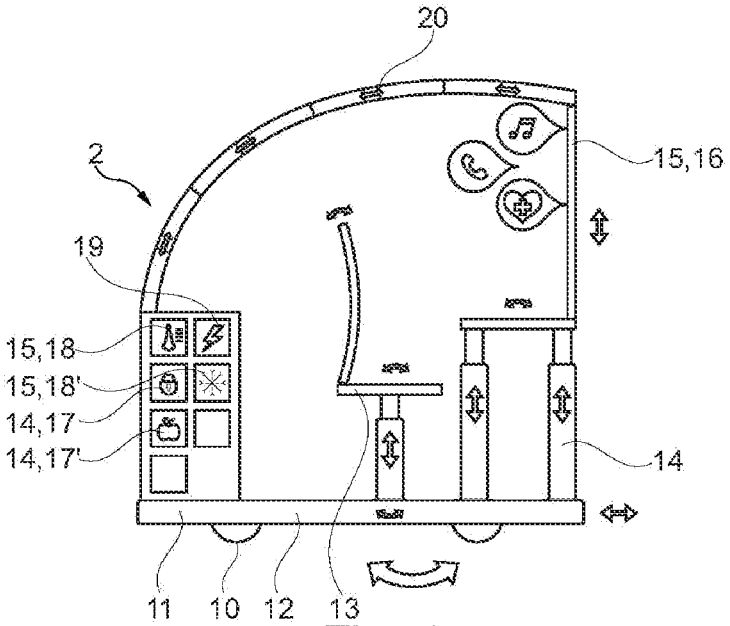
FIG. 1 shows a greatly simplified schematic representation of an item of seating furniture of a seating furniture system.

FIG. 1 shows a highly simplified schematic representation of an item of seating furniture 2 of a seating furniture system 1 with a seating frame 11, where a seating assembly 12, a footrest 13, and a table assembly 14 are provided on the seating frame 11. A drive, such as motor 104 shown in FIG. 6, a running gear 10, and a control unit 100 (shown in FIG. 6) are also provided. The drive can be addressed by the control unit 100 and can drive the running gear 10. The running gear 10 can have a lifting mechanism, by means of which the seating frame 11 can be raised and lowered, for example before the item of seating furniture 2 is to be moved or when the item of seating furniture is to be parked. A power storage system 102 may also be provided for supplying the seating furniture 2 with energy.

The item of seating furniture 2 also has sensors (not shown) that can detect the surroundings of the item of seating furniture 2. As a result, the item of seating furniture 2 can be moved safely, like a vacuum cleaner robot, for example. The item of seating furniture 2 can also include a sensor system (not shown) which can record, for example, the air quality (purity, temperature, flow, etc.), voice commands, and/or gestures of the user.

The seating assembly 12 can preferably be adjusted between at least two seat positions—see FIGS. 2*a* to 2*d*—one of the at least two seat positions being a lounge seat position, a working chair position, a standing stool position, or a leaning position. As shown in FIG. 1, a large number of adjustments can be made, which are indicated by double arrows. This can include, for example, a rotation angle, a seat height, a seat surface inclination, and a reclining position, although this list is not exhaustive.

The table assembly 14 in the illustrated exemplary embodiment forms a seating niche that partially encloses the footrest 13 and forms a comfort zone for the user. The table assembly 14 can comprise one or more storage options 17, 17', each storage option 17 being a small safe or cupboard which can be used for storing personal items, for example. The table assembly 14 can also be individually adjusted independently of the seating assembly 121. For example, the table assembly can be adjusted in height and depth in relation to the seating assembly 12 or can have integrated monitors that can be adjusted electrically in order to meet the individualized needs of the user.

The footrest 13 offers the user a place to put their feet without the risk of the feet coming into contact with the floor when the item of seating furniture 2 moves.

The seating assembly 12 can preferably be adjusted between at least two seat positions, one of the at least two seat positions being a lounge seat position, a working chair position, a standing stool position, or a leaning position.

In addition, the item of seating furniture 2 has a comfort, work, and/or entertainment device (CWE) 15 which can or does include for example, a stimulation or massage device (106) of the seating assembly 12, an air conditioning system (AC1) 110 of the seating assembly 12, an air conditioning system (AC2) 112 of a foot space on the footrest, a multimedia conference device (MCD) 108, and/or a computer workstation 114. The comfort, work, and/or entertainment device 15 can also adjust the seat positions automatically. The comfort, work, and/or entertainment device 15 can comprise an input and output unit 16 which, for example, comprises at least one screen, a touch screen, a microphone, a loudspeaker, a keyboard, a mouse, a touchpad, and/or the like. The input and output unit 16 can be extended and retracted but also pivoted. The comfort, work, and/or entertainment device 15 can also include an IR, UVA and UVB light source 116.

The comfort, work, and/or entertainment device 15 can have storage options 17, 17'. The storage options 17, 17' can be a small safe 17 or cupboard 17' which can be used for storing personal items. In a preferred embodiment, the storage option also has locking means which can preferably be opened and closed by user identification means. The storage option 17' can also be air-conditioned and store, for example, snacks or soft drinks which can be made available to the user, for example at a conference, a meeting, a training course, or the like. The at least one storage option also allows other objects to be integrated, such as filing cabinets, in other niche solutions.

Furthermore, an air conditioning system 18, 18' can be provided, which is designed to provide the user with pleasant indoor air. The seating assembly 12 can also be heated or cooled, or the temperature of the table assembly can be controlled accordingly. Additives such as oxygen or fragrances can be added to the air.

Furthermore, a shielding device 20 is provided, which can be a component of the comfort, work, and/or entertainment device 15. The shielding device 20 can, for example, implement a soundproofing concept (see FIG. 2*b*), a sun protection concept (see FIG. 2*c*), or a privacy concept (see FIG. 2*d*). The shielding device 20 according to the exemplary embodiment shown can be designed in the manner of a convertible top and/or in the manner of a hard top, which can be activated manually or automatically and by the controller or put on separately. The shielding device 20 can protect against prying eyes and/or serve to isolate the individual from noise that affects oneself and/or others.

FIGS. 2*a* to 2*d* show different usage formats of the item of seating furniture 2.

Figure 2A:
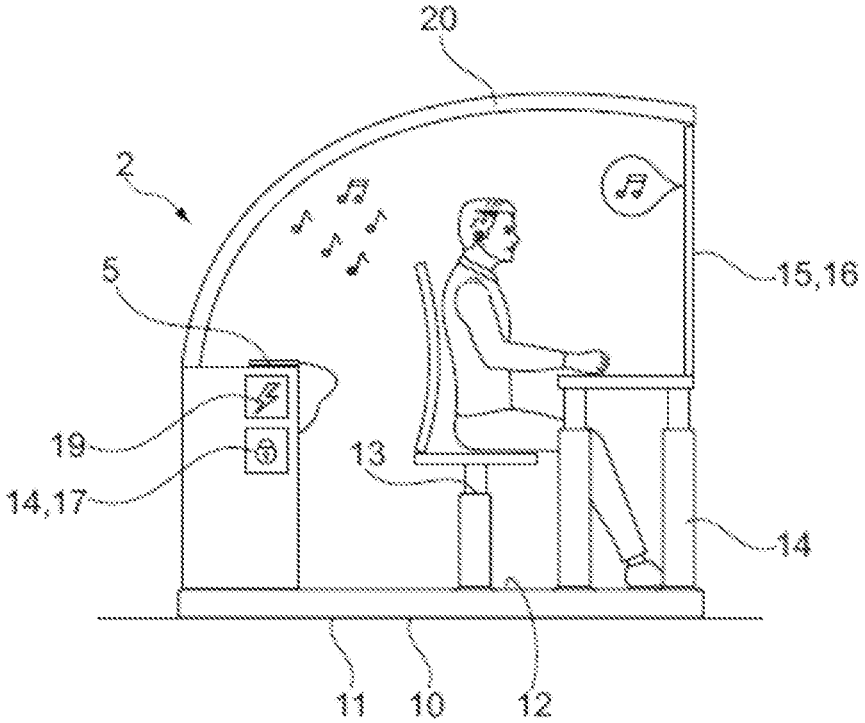
FIGS. 2*a*-2*d* show different application formats of the item of seating furniture according to FIG. 1.

FIG. 2*a* shows a user using the item of seating furniture 2. The user has brought their personal hardware 5 with them in the form of a laptop and can connect it to the item of seating furniture via an interface. The item of seating furniture 2 provides electrical energy for the personal hardware via a power connection 19. Via the user profile of the personal hardware 5, pre-adjustments to the seating furniture 2 can be made, which allow individualization for the user.

Figure 2B:
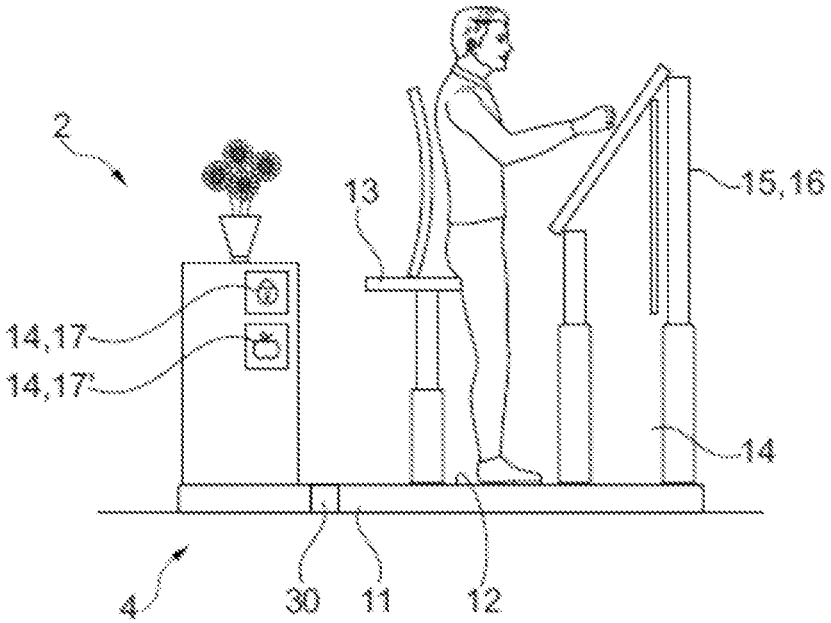

FIG. 2*b* shows an item of seating furniture 2, with an additional object 4 being coupled via a coupling means 30 to the item of seating furniture 2 with storage options 17, 17'. The seating assembly 12 and the table assembly 14 are adjusted according to the preferences of the user and form a standing stool with a standing desk.

Figure 2C:
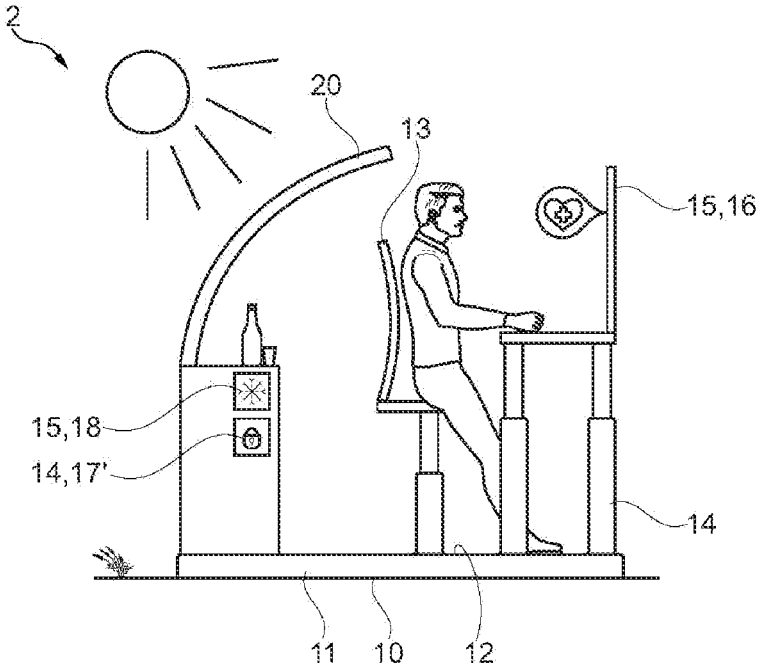

FIG. 2*c* shows an item of seating furniture 2, with the shielding device 20 forming a sunshade. A sensor system can determine the necessary shading of the seating assembly 12 and the table assembly 14, and the shielding device 20 can be controlled accordingly in order to create the best possible working atmosphere.

Figure 2D:
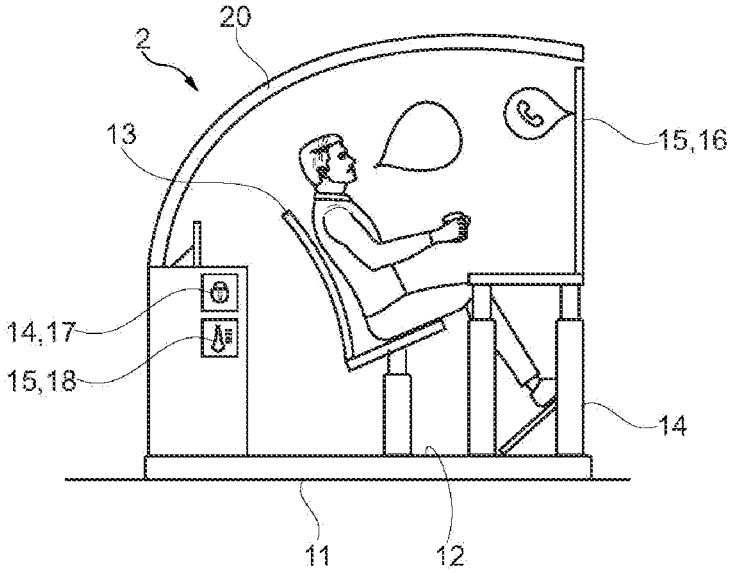

According to FIG. 2*d*, the shielding device 20 can also provide privacy and can both protect the user from prying eyes and create an undisturbed conversation atmosphere that allows confidential conversations.

It can be seen from the different setups according to FIGS. 2*a* to 2*d* that the seating assembly 12 and/or the table assembly 14 can be adapted as desired to the needs of the user. The atmosphere can also be adjusted for the user to create a healthy and creative environment.

Figure 3:
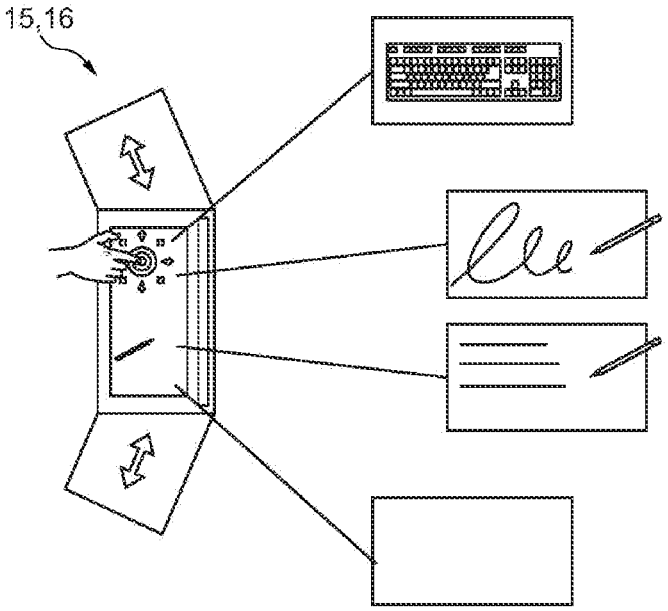
FIG. 3 shows a schematic representation of an input and output unit of the item of seating furniture.

FIG. 3 shows an input and output unit 16 that is designed for all possible usage formats. The input and output unit 16 can be adjusted as desired according to the movements indicated by double arrows and can assume the function of a computer workstation or an entertainment system. Presentations can be shown or played back interactively, or content or messages can be exchanged.

Figure 4A:
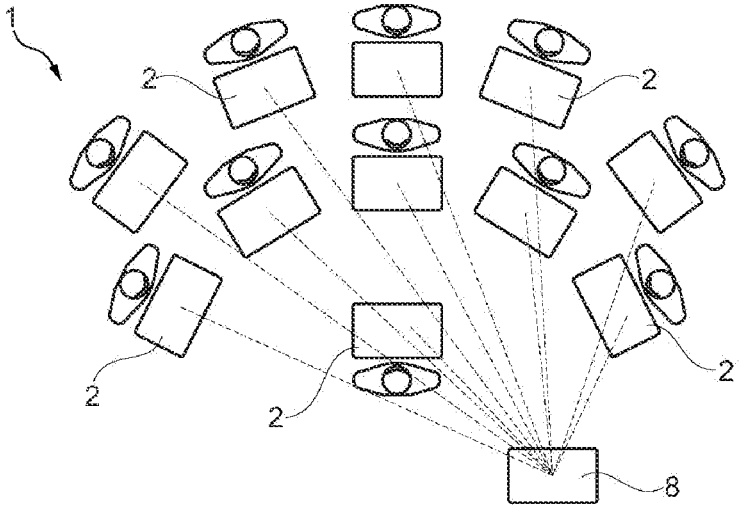
FIGS. 4*a*-4*c* show a schematic representation of a seating furniture assembly of the seating furniture system.
Figure 4B:
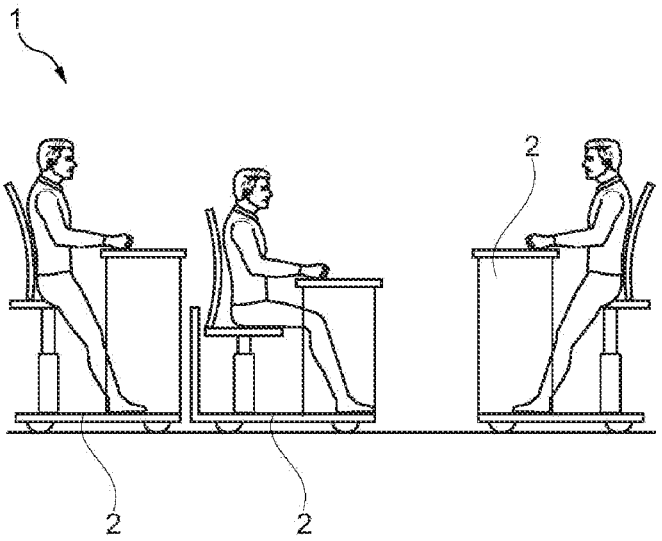
Figure 4C:
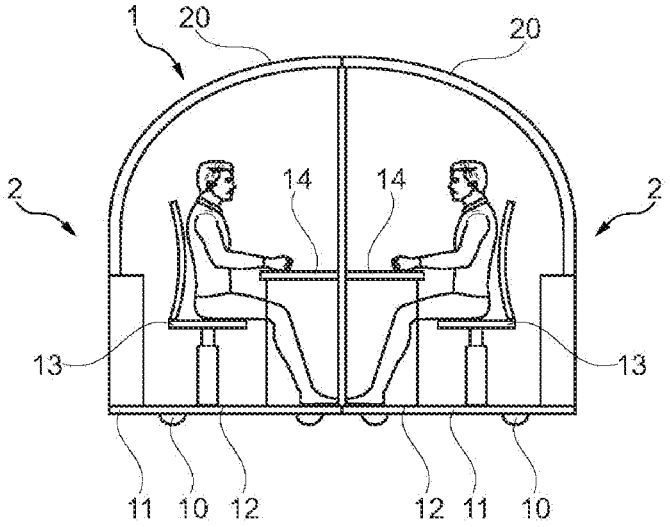

FIGS. 4*a* to 4*c* show different seating furniture assemblies that can be implemented by a seating furniture system 1 having at least one item of seating furniture 2. The seating furniture system 1 can have a higher-level controller 8 which can exchange control commands with the at least one item of seating furniture 2. A communication connection is indicated by a dashed line in FIG. 4*a*.

The seating furniture system 1 can, for example, specify a seating furniture assembly as shown in FIG. 4*a*, with the items of seating furniture 2 being arranged, preferably autonomously. It is possible to specify the seating furniture assembly by using an appropriate computer program, for example by drag & drop, or individual users can book specific seating furniture 2 in the manner of a booking system, for example to experience the format offered from a preferred position. The items of seating furniture 2 would be bookable, in a similar way to seats in an airplane, in conjunction with a digital map of the rooms, with further authorizations, roles, or additional objects optionally being bookable for each item of seating furniture.

The user of the item of seating furniture 2 according to FIG. 4*a* can adjust or configure the respective item of seating furniture 2 according to their own preferences and desires, with some parameters being able to be specified by the organizer, for example. For example, the seat heights in the different rows of seats according to FIG. 4*a* can be set at different heights so that every user can have the best possible view. This can eliminate the need for complex room designs.

To form small work groups, two items of seating furniture 2 can be brought into position relative to one another as shown in FIG. 4*c*, it being possible for sensors on the respective items of seating furniture 2 to monitor a distance between the items of seating furniture 2, thereby ensuring automated maintenance of a minimum distance between the users, and—particularly in times of pandemics—allowing hygiene concepts to be implemented and monitored. The shielding devices 20 can shield the working group that has been formed in order to create a suitable working atmosphere.

Figure 5:
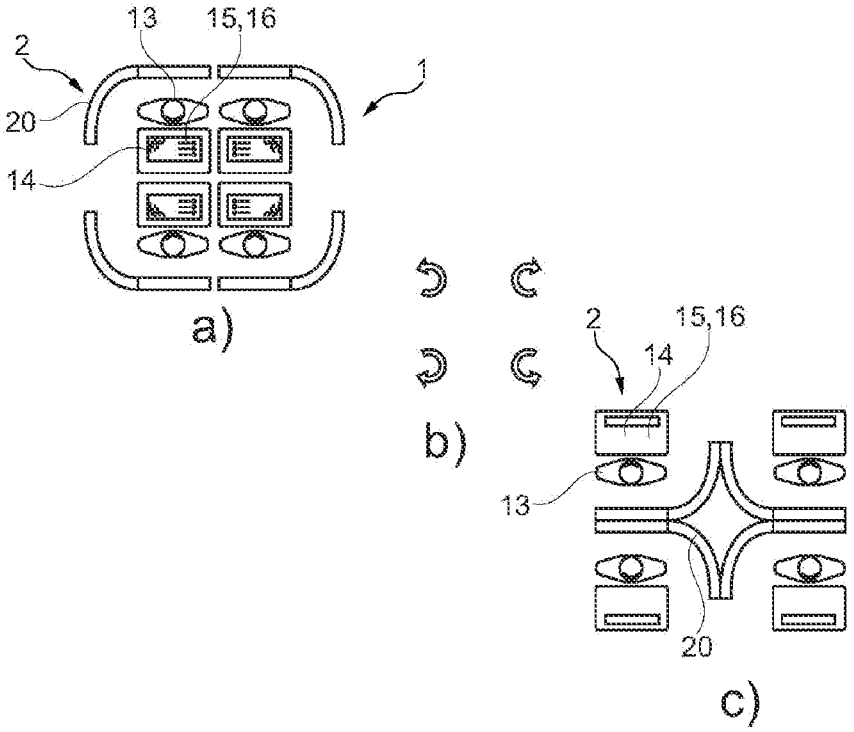
FIGS. 5*a*-5*c* show a schematic representation of another seating furniture assembly of the seating furniture system and the adjustment options thereof.

FIGS. 5*a* to 5*c* show an exemplary use of the seating furniture system 1 for implementing different seating furniture assemblies. According to FIG. 5*a*, working groups can come together, for example for team meetings. At the end of the meeting, the items of seating furniture 2 of this seating furniture assembly can be moved by the furniture system 1 as per the adjustment directions shown in FIG. 5*b*, as a result of which the seating furniture assembly now assumes an arrangement in which the participants of the meeting are again arranged at a single workstation. The shielding device can extend both over the seating assembly 13 and/or table assembly 14 and also shield them at the sides so as to form a niche.

LIST OF REFERENCE NUMERALS

1 Seating furniture system
2 Item of seating furniture
4 Additional object
5 Hardware
8 Controller
10 Running gear
11 Seating assembly
12 Seating assembly
13 Footrest
14 Table assembly
15 Comfort, work, and/or entertainment device
16 Output unit
17 Storage option
18 Air conditioning system
19 Power connection
20 Shielding device
30 Coupling means

The invention claimed is:

1. An item of seating furniture (2), comprising:

a seating frame (11) with a running gear (10) and with at least one seating assembly (12), a table assembly (14), and a footrest (13);

a power storage system which supplies the seating furniture (2) with energy;

a control unit (100);

user identification means for identifying a user; and a comfort, work and/or entertainment device (15), wherein the control unit controls the comfort, work and/or entertainment device (15), and wherein the control unit is configured to control the comfort, work and/or entertainment device (15) according to a user profile associated with the user identified by the user identification means.

2. The item of seating furniture according to claim 1, characterized in that the running gear is driven by a motor, the motor being controlled by the control unit.

3. The item of seating furniture (2) according to claim 2, characterized in that coupling means (30) are provided, by means of which additional objects (4) can be coupled to the item of seating furniture (2).

4. The item of seating furniture (2) according to claim 3, characterized in that the additional objects (4) comprise the motor, a plant, a second running gear, and/or the table assembly.

5. A seating furniture system (1) having at least one item of seating furniture (2) according to claim 2, and a higher-level controller (8), wherein the higher-level controller (8) can communicate with the control unit of the at least one item of seating furniture (2).

6. A method for operating a seating furniture system (1) according to claim 5, comprising transmitting at least one control command between the at least one item of seating furniture (2) and the higher-level controller (8).

7. The method according to claim 6, characterized in that the motor is controlled to move the item of seating furniture (2).

8. The method according to claim 6, characterized in that the comfort, work and/or entertainment device (15) of the at least one item of seating furniture (2) can be adjusted using settings predefined in the user profile.

9. The seating furniture system (1) according to claim 5, wherein the at least one item of seating furniture (2) comprises a plurality of items of seating furniture, the plurality of items of seating furniture being controlled in a coordinated manner by the higher-level controller (8).

10. The item of seating furniture (2) according to claim 1, characterized in that a seat position of the seating assembly (12) of the comfort, work, and/or entertainment device (15) can be adjusted between at least two seat positions, one of the at least two seat positions comprising a lounge seat position, a working chair position, a standing stool position, or a leaning position.

11. The item of seating furniture (2) according to claim 1, characterized in that the comfort, work, and/or entertainment device (15) comprises a stimulation or massage device of the seating assembly (12), an air conditioning system of the seating assembly, an IR, UVA, and UVB light source, and/or an air conditioning system of a foot space on the footrest (13).

12. The item of seating furniture (2) according to claim 1, characterized in that the comfort, work, and/or entertainment device (15) comprises a multimedia conference device and/or a computer workstation.

13. The item of seating furniture (2) according to claim 1, characterized in that a shielding device (20) is provided, by means of which at least one seating assembly (12) can be shielded.

14. The item of seating furniture (2) according to claim 1, wherein the control unit (100) is configured to control the running gear (10) to move the seating frame (11) to a desired location.

15. The item of seating furniture (2) according to claim 14, wherein the control unit (100) is configured to automatically move the seating frame (11) to a desired location.

* * * * *